United States Patent [19]

Stewart

[11] Patent Number: 4,703,981

[45] Date of Patent: Nov. 3, 1987

[54] COLLAPSIBLE CABINET

[75] Inventor: Stephen P. Stewart, Oklahoma City, Okla.

[73] Assignee: Stewart Industries, Inc., Oklahoma City, Okla.

[21] Appl. No.: 821,268

[22] Filed: Jan. 22, 1987

[51] Int. Cl.[4] ..... A47B 43/00

[52] U.S. Cl. ..... 312/258; 217/48; 220/6; 220/7

[58] Field of Search ..... 312/350, 258, 109, 326–329; 220/6, 7; 217/48; 16/221, 387; 292/251.5; 49/381, 501; 160/135

[56] References Cited

U.S. PATENT DOCUMENTS

| | | | |
|---|---|---|---|
| 168,879 | 10/1875 | Colbert . | |
| 889,741 | 6/1908 | Additon . | |
| 933,210 | 9/1909 | Ullom . | |
| 963,769 | 7/1910 | Johnson et al. . | |
| 1,342,269 | 6/1920 | Stewart . | |
| 1,559,878 | 11/1925 | Humphreys . | |
| 1,576,284 | 3/1926 | Jones . | |
| 2,483,340 | 9/1949 | Gilbart | 312/144 |
| 2,489,154 | 11/1949 | Relton | 292/251.5 |
| 2,583,931 | 1/1952 | Cummings | 312/262 |
| 3,430,386 | 3/1969 | Sandin et al. | 312/109 |
| 4,214,669 | 7/1980 | McQuiston | 220/6 |
| 4,482,195 | 11/1984 | Chapin | 312/210 |

FOREIGN PATENT DOCUMENTS

| | | | |
|---|---|---|---|
| 261318 | 10/1947 | Switzerland | 312/258 |

*Primary Examiner*—Joseph Falk

*Attorney, Agent, or Firm*—Laney, Dougherty, Hessin & Beavers

[57] ABSTRACT

A collapsible storage cabinet having a set-up, operating position and a collapsed, storage position. The cabinet includes a pair of side portions, a rear portion formed by a pair of hinged rear panels, a front portion including two hinged doors, and a top portion. Each side portion includes a vertical front leg and a vertical rear leg with a side panel extending therebetween. The rear panels forming the rear portion are hingingly attached to the rear legs such that the rear panels are perpendicular to the side portions when the cabinet is in the operating position and are parallel to the side portions when the cabinet is in the storage position. Each door is reversibly hingingly attached to a front leg such that the doors may be pivoted inwardly when the cabinet is in the storage position, and pivoted outwardly when the cabinet is in the operating position. Each of the doors has a vertical groove therein into which is received an edge of the corresponding front leg when the door is in a fully opened position. When the cabinet is collapsed, the doors, rear panels and side panels define storage cavities therebetween for storingly receiving removable panels positionable in the cabinet. At least one shelf is provided which has touch-release latches thereon which eliminate the need for external hardware on the doors. The storage cavity includes latch receiving recesses therein for receiving the latches when the corresponding shelf is placed in the storage cavity.

21 Claims, 11 Drawing Figures

COLLAPSIBLE CABINET

BACKGROUND OF THE INVENTION

1. Field of the Invention

This invention relates to collapsible cabinets, and more particularly, to a collapsible cabinet having an inwardly and outwardly pivoted door and defining a shelf storage cavity therein when collapsed to a storage position.

2. Description Of The Prior Art

Several known collapsible storage cabinets are disclosed in U. S. Pat. Nos. 168,879 to Colbert; 889,741 to Addition; 933,210 to Ullom; 1,342,269 to Stewart; 2,483,340 to Gilbart; and 2,583,931 to Cummings. These patents illustrate a number of different configurations, but one disadvantage to each of these is that the doors are attached so that they are pivotable only outwardly. Thus, the doors are exposed when the cabinet is placed in a storage position. The present invention in which the doors pivot inwardly and are totally enclosed when the cabinet is in a storage position provides and advantage in that the doors are protected during storage.

Further, with the present invention, the apparatus may be folded to a very compact storage position because the shelves are removable. In order for this to be effective, the present invention defines shelf storage cavities therein for storage and protection of the removable shelves.

SUMMARY OF THE INVENTION

The collapsible cabinet of the present invention has a setup, operating position and a collapsed, storage position and comprises side support means, folding back means attached to the side support means, door means adjacent the side support means and opposite the back means, and reversible hinge means for hingingly attaching the door means to the side support means.

The folding back means has a position substantially perpendicular to the side support means when the cabinet is in the operating position and further has a position substantially parallel to the side support means when the cabinet is in the storage position.

The reversible hinge means provides inward pivotation of the door means with respect to the side support means when the cabinet is in the storage position and outward pivotation of the door means with respect to the side support means when the cabinet is in the operating position. The reversible hinge means allows pivotation of the door means through an angle greater than 180°.

The cabinet preferably further comprises removable shelf means positionable substantially horizontally when the cabinet is in the operating position. The shelf means comprises means for preventing folding of the back means and inward pivotation of the door means when the cabinet is in the operating position.

In the preferred embodiment, the support means, folding back means and door means define storage means therebetween when the cabinet is in the storage position for storingly receiving the shelf means. The storage means is best characterized by a vertically oriented storage cavity.

The door means defines a longitudinal, vertical groove therein adjacent the side support means, such that as the door means is outwardly hinged to a fully opened position, the groove in the door means receives therein an edge of the side support means. In this way, the door means may be mounted more closely to the side support means such that any gap therebetween is minimized.

In the preferred embodiment, the reversible hinge means is characterized by an upper hinge having a portion attached to the top edge of the door means and a lower hinge having a portion attached to the bottom edge of the door means. The hinge means thus does not restrict forward and rearward pivotation of the door means as would be the case with normal hinges attached to the side of the door means.

The cabinet of the present invention further comprises latch means on the shelf means for releasably latching the door means when the shelf means is in the horizontal, operating position thereof. Latch receiving means are provided in the storage means for receiving the latch means when the shelf means is placed in a storage position within the storage means.

The side support means is best characterized by a pair of spaced side portions, and the door means comprise a pair of doors, each of the doors being hingingly attached to a corresponding side portion. Each of the side portions comprises a front leg having a longitudinal groove therein, a rear leg having a longitudinal groove therein aligned with the groove in the front leg, and a substantially vertical side panel extending between the legs and having a front edge adapted for installation in the groove in the front leg and a rear edge adapted for installation in the groove in the rear leg.

A lowermost portion of the storage cavity is defined by a rib extending across the side portion. This rib provides support for the shelf means when the shelf means are placed within the storage means. A second rib is spaced above the first-mentioned rib, and the second rib is transversely narrower than the first-mentioned rib which provides clearance for, and guidance of, the shelf means when stored. Alternately, a rib similar to the uppermost rib may be positioned at the uppermost portion of the storage cavity. It will be seen that this uppermost rib provides means for confining the shelf means in the storage means. These ribs also provide structural support for the side support means.

The cabinet further comprises a top portion having a substantially horizontal operating position which is engageable with the side portions.

An important object of the present invention is to provide a collapsible cabinet having a set-up, operating position and a collapsed, storage position.

Another object of the present invention is to provide a collapsibe cabinet requiring no tools or loose hardware for setting up in an operating position.

Still another object of the invention is to provide a collapsible cabinet having reversible hinge means such that doors thereon may be pivoted inwardly for protection during storage and outwardly for normal operation.

An additional object of the present invention is to provide a cabinet defining storage means in the form of a storage cavity for storingly receiving a removable shelf when the apparatus is in a storage position.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
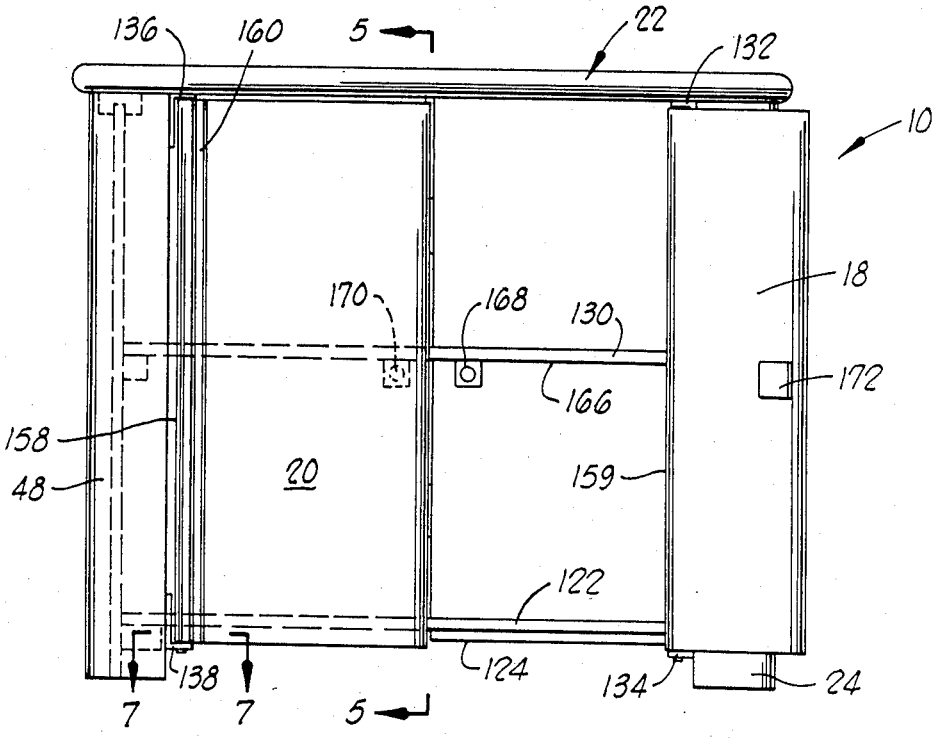
FIG. 1 shows a front elevation of the collapsible storage cabinet of the present invention with the left door (as seen by the viewer) closed and the right door opened.

Referring now to the drawings, and particularly to FIGS. 1-6, the collapsible storage cabinet of the present invention is shown in a set-up, operating position and generally designated by the numeral 10. Cabinet 10 comprises side support means in the form of a pair of side portions 12 and 14, a rear portion 16, a front portion including doors 18 and 20, and a top portion 22.

Side portion 12 includes a substantially vertical front leg 24 and a substantially vertical rear leg 26 parallel to, and spaced from, the front leg. Front leg 24 defines a longitudinal groove 28 therein facing rear leg 26. Similarly, rear leg 26 has a longitudinal groove 30 therein aligned with groove 28 in front leg 24. A substantially vertical, planar side panel 32 extends between front leg 24 and rear leg 26. Side panel 32 has a front edge 34 which is received in groove 28 and a rear edge 36 which is received in groove 30.

Figure 2:
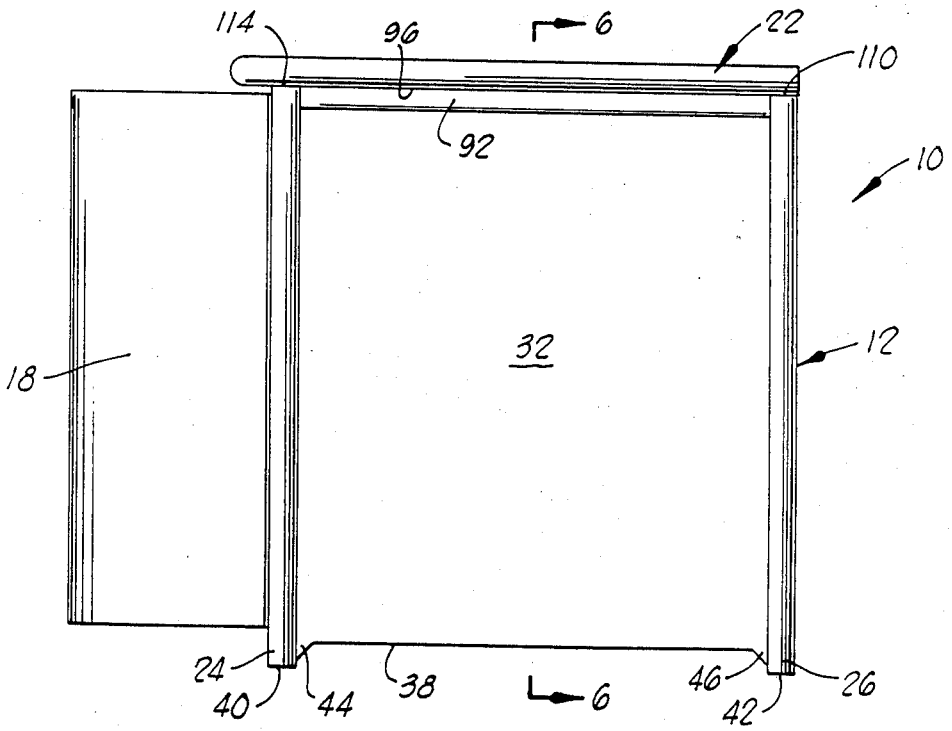
FIG. 2 is a side elevation view of the apparatus with one door opened.
Figure 3:
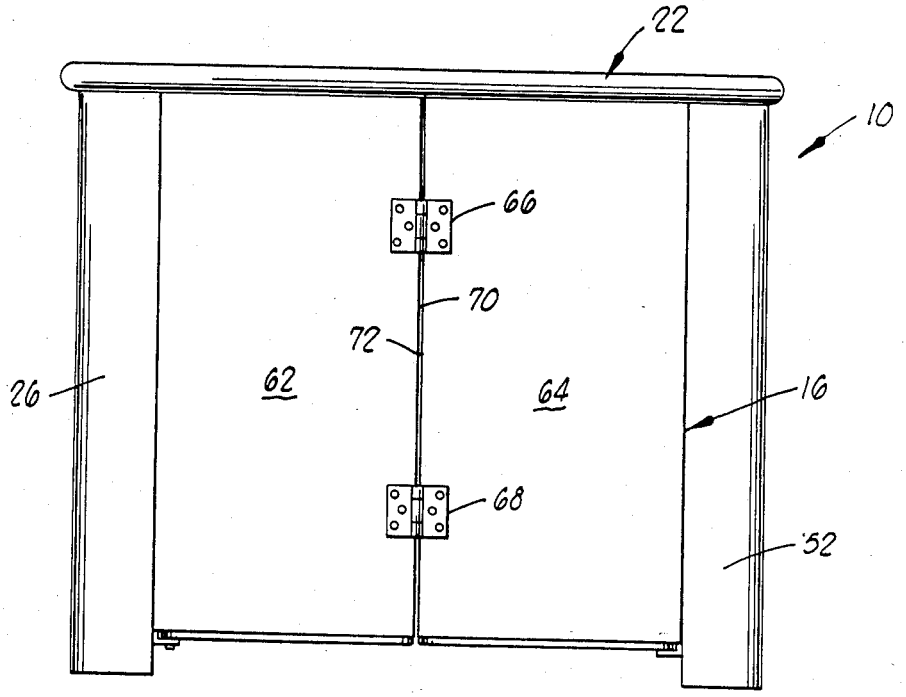
FIG. 3 illustrates a rear elevation of the apparatus.

Referring to FIG. 2, it will be seen that side panel 13 has a lower edge 38 spaced above lower ends 40 and 42 of front legs 24 and 26, respectively. Tapered portions 44 and 46 of side panel 32 provide maximum contact of front edge 34 with groove 28 and rear edge 36 with groove 30, respectively.

Side portion 14 is of substantially identical construction as side panel 12, and includes a front leg 48 with a longitudinal groove 50 therein, a rear leg 52 with a longitudinal groove 54 therein, and a side panel 56 extending between the front and rear legs. Side panel 56 has a front edge 57 received in groove 50 and a rear edge 58 received in groove 54. Side panel 56 also has a lower edge 59 and tapered portions 60 and 61 (shown in FIG. 5) corresponding to lower edge 30 and tapered portions 44 and 46 of side panel 32.

Rear portion 16 comprises a pair of substantially vertical, planar rear panels 62 and 64 hingingly attached to one another by hinges 66 and 68 along inwardly directed edges 70 and 72 thereof, respectively. As seen in the drawings, hinges 66 and 68 are attached to outer surface 74 of rear portion 16.

Figure 4:
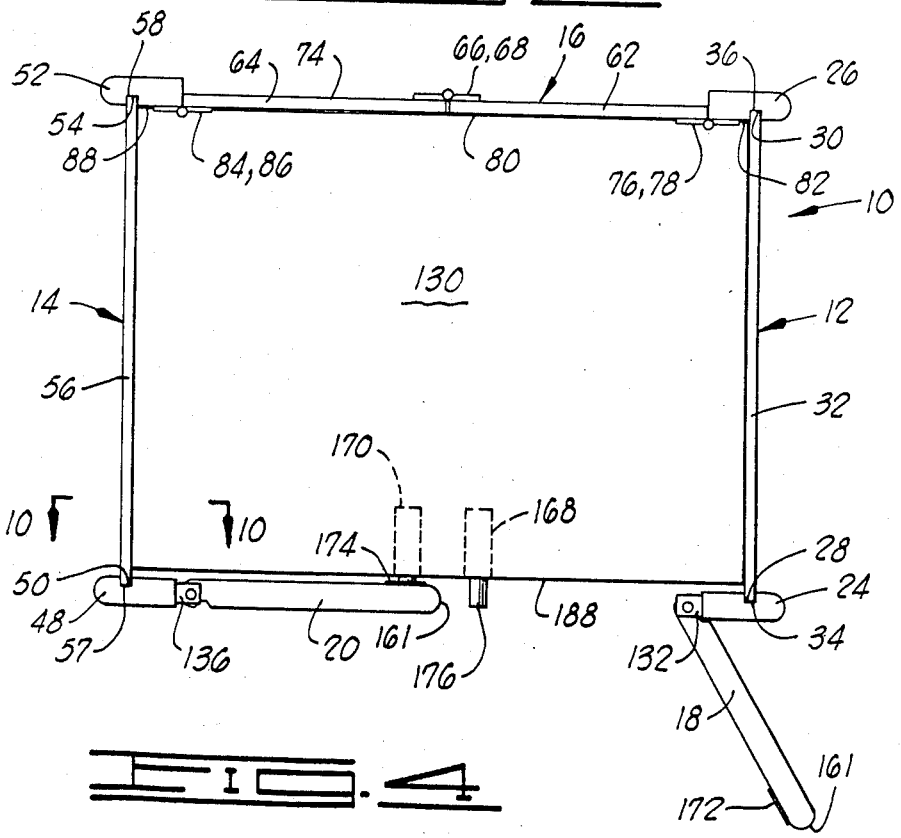
FIG. 4 is a top view of the apparatus with a top portion removed.

Rear panel 62 is hingingly attached to rear leg 26 by a pair of hinges 76 and 78. As seen in FIG. 4, hinges 76 and 78 are located on inner surface 80 of rear portion 16 and on inner surface B2 of leg 26 which is aligned with surface 80. Similarly, rear panel 64 is hingingly attached to rear leg 52 by a pair of hinges 84 and 86. Hinges 84 and 86 are also located on inner surface 80 of rear portion 16 which is likewise aligned with inner surface 88 of leg 52. As will be further described hereinafter, it will be seen that hinges 76, 78, 84 and 86 are adapted so that back panels 62 and 64 may hinge inwardly toward side panels 32 and 56, respectively. At the same time, hinges 66 and 68 allow rear panels 62 and 64 to hinge toward one another, thus forming a folding back means for cabinet 10.

Figure 5:
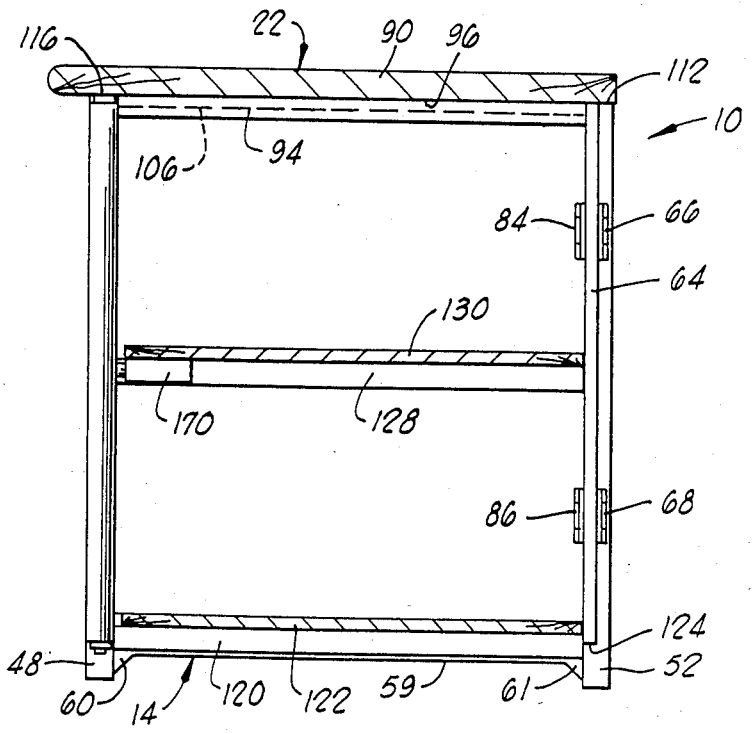
FIG. 5 is a cross-sectional view taken along lines 5—5 of FIG. 1.
Figure 6:
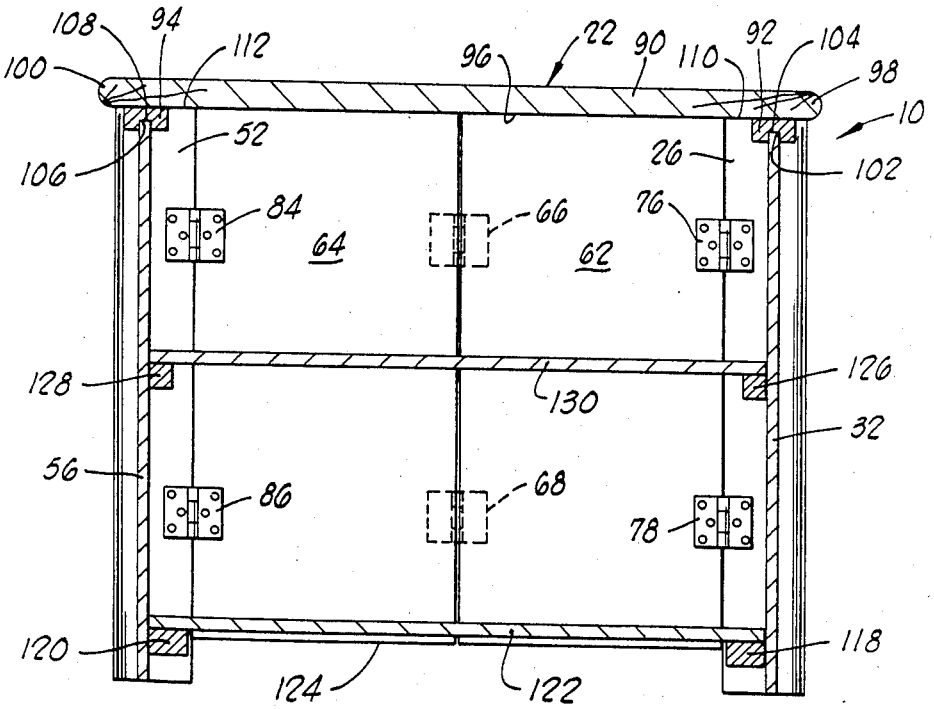
FIG. 6 is a cross-sectional view taken along lines 6—6 of FIG. 2.

Referring now primarily to FIGS. 2, 5 and 6, it will be seen that top portion 22 includes a top panel 90 with a pair of elongated, parallel mounting ribs 92 and 94 attached to a lower surface 96 thereof at opposite side ends 98 and 100, respectively. Rib 92 defines a longitudinal groove 102 therein adapted for receiving top edge 104 of side panel 32. Similarly, rib 94 has a longitudinal groove 106 therein adapted for receiving top edge 108 of side panel 56. Lower surface 96 of top panel 90 will be approximately in contact with upper ends 110, 112, 114 and 116 of legs 26, 52, 24 and 48, respectively. The length of ribs 92 and 94 are such that the ribs fit closely between the corresponding pair of front and rear legs, so that top portion 22 may not slide forward or rearward when in the operating position.

Extending horizontally between front leg 24 and rear leg 26 at a lower end thereof is a lower support rib 118, as best seen in FIGS. 5 and 6. A similar lower support rib 120 extends between front leg 48 and rear leg 52 and is co-planar with rib 118. Horizontally positioned on ribs 118 and 120 is a removable, planar lower shelf 122. In the preferred embodiment, lower shelf 122 extends between side panels 32 and 56 and between the front and rear legs so that it closes the lower part of cabinet 10. Also, lower shelt 122 is preferably positioned above lower end 124 of rear portion 16.

It will be seen by those skilled in the art that when top portion 22 and lower shelf 122 are in place when cabinet 10 is in the set-up, operating position shown in FIGS. 1-6, the cabinet forms a rigid assembly in which hinges 66, 68, 76, 78, 84 and 86 on rear portion 16 are inoperative.

In the embodiment shown in the drawings, an intermediate support rib 126 extends between front leg 24 and rear leg 26 at a vertically intermediate point along side panel 32. Similarly, an intermediate support rib 128 extends between front leg 48 and rear leg 52 and along side panel 56. Ribs 126 and 128 horizontally co-planar.

Referring to FIG. 6, it will be seen that the transverse width of rib 126 is narrower than that of rib 118, and the transverse width of rib 128 is narrower than that of rib 120. Extending between side panels 32 and 56 and between the front and rear legs is a planar, intermediate shelf 130 which is adapted to be removably positioned on top of ribs 126 and 128. Although only one set of ribs 126 and 128 and intermediate shelf 130 are shown for the purposes of this disclosure, it will obvious to those skilled in the art that any number of intermediate shelves 130, along with corresponding intermediate support ribs 126 and 128, could be positioned in cabinet 10 as desired, depending upon the height of cabinet 10. Only one such shelf is shown in this disclosure simply for simplicity, and the apparatus is not intended to be limited to one such intermediate shelf. Obviously, when intermediate shelf 130 is in position, cabinet 10 forms an even more rigid structure.

Further, when top portion 22 is in place, side panels 32 and 56 lockingly bear against shelves 122 and 130 for additional rigidity.

Referring to FIGS. 1 and 4, doors 18 and 20 form a front portion of cabinet 10 as already mentioned. Door 18 is shown in a fully open operating position, and door 20 is shown in a closed operating position. Both doors may be variably opened, of course. Door 18 is hingingly attached to front leg 24 by means of a top hinge 132 and a bottom hinge 134. Door 20 is hingingly attached to leg 48 in a similar manner by a top hinge 136 and a bottom hinge 138.

Figure 7:
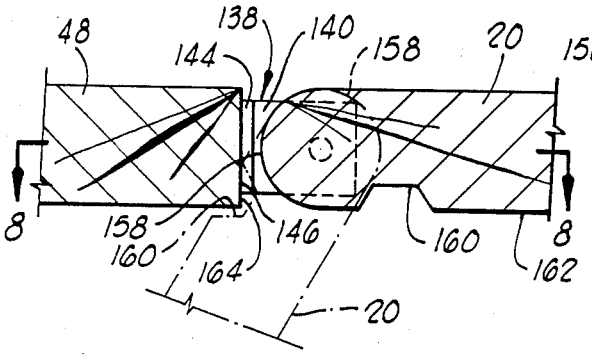
FIG. 7 is a cross-sectional view taken along lines 7—7 in FIG. 1 showing the detail of the door and hinge configuration.
Figure 8:
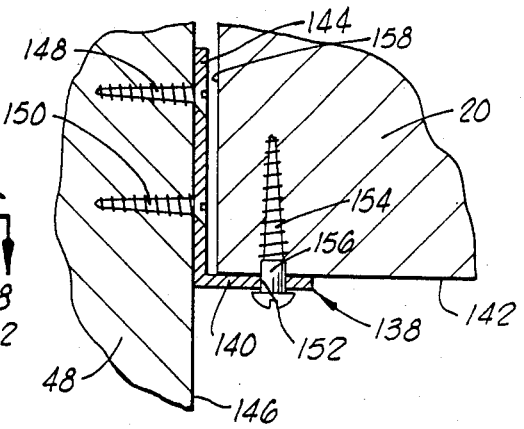
FIG. 8 is a cross section taken along lines 8—8 in FIG. 7.

Referring now to FIGS. 7 and 8, the details of bottom hinge 138 on door 20 are shown. It will be seen by those skilled in the art that top hinge 132 and bottom hinge 134 on door 18 and top hinge 136 on door 20 are similar in construction, and thus the following description of hinge 138 is representative of these other hinges.

Hinge 138 is of a substantially L-shape having a horizontal portion 140 adjacent horizontal lower surface 142 of door 20. Extending from horizontal portion 140 is a vertical portion 144 attached to vertical edge 146 of leg 48 by a pair of flathead screws 148 and 150 or other fastener means. Horizontal portion 140 has a hole 152 therethrough, and a screw 154 with a vertical axis extends through hole 152 and is attached to door 20. Preferably, screw 154 has a substantially cylindrical portion 156 which is positioned in hole 152. Because screw 154 is attached to door 20, screw 154 will move with the door. Thus, it will be seen that cylindrical portion 156 acts as a bearing within hole 152 as door 20 is pivoted with respect to hinge 138. Hinges 132, 134 and 136 are constructed and attached in a similar manner to horizontal surfaces of the corresponding door and the corresponding vertical edge of the legs.

As seen in FIG. 1, door 20 has a curvilinear vertical edge 158 adjacent and parallel to edge 146 of leg 48, and door 18 has a similar curvilinear vertical edge 159. A study of FIG. 7 will show that hinges 136 and 138 provide reversible hinge means for allowing door 20 to pivot both in a rearward direction and a forward direction with respect to leg 48. Hinges 132 and 134 provide similar reversible hinge means for door 18.

Doors 18 and 20 have adjacent, curved edges 161, as seen in FIG. 4, which allow the doors to be positioned closely together while facilitating reverse pivotation.

Door 20 defines a vertical, longitudinal slot 160 in front surface 162 thereof. Door 18 has a corresponding slot. Referring to FIG. 7, it will be seen that slot 160 allows clearance for corner 164 of leg 48 so that door 20 may be pivoted outwardly with respect to leg 48 through an angle greater than 90°. Door 20 is shown in solid lines in FIG. 7 in a closed, operating position and is shown in phantom in the fully open, operating position. This use of slot 160 allows edge 158 of door 20 to be positioned closer to edge 146 of leg 46, thus reducing the gap therebetween.

It will be seen that in the set-up, operating position of cabinet 10, lower shelf 122 and intermediate shelf 130 provide means for preventing inward pivotation of doors 18 and 20, although their respective top hinges 132 and 136 and bottom hinges 134 and 138 would otherwise allow the doors to be so pivoted, and the shelves also provide means for preventing folding of rear portion 16.

Attached to lower surface 166 of intermediate shelf 130 are latch means in the form of a pair of touch-release latches 168 and 170. Latches 168 and 170 magnetically attach to latch plates 172 and 174 on doors 18 and 20, respectively. Latches 168 and 170 are of a kind known in the art having a plunger 176 which has a contracted, closed position as indicated for latch 170 in FIG. 4 and an extended, open position as indicated for latch 168 in FIG. 4. Even in the closed position, plunger 176 extends slightly forwardly from shelf 130. When a door is in the closed position as shown for door 20, simply pushing on the outer surface of the door causes plunger 176 to move to the extended position. This occurs very quickly, and the momentum imparted to the door will cause latch plate 172 or 174 thereon to break magnetic contact with plunger 176 in latch 168 or 170 so the door swings away from the latch. In closing, the door is swung back so that latch plate 172 or 174 is again in contact with the corresponding plunger 176. The door is pushed toward the latch so that plunger 176 relatches into the closed position. Such touch-release latches as 168 and 170 provide a simple latching mechanism, and eliminate the necessity for door pulls on the outside of doors 18 and 20. The importance of the elimination of such door pulls or other exterior hardware will become more evident in the subsequent discussion herein of the collapsed, storage position of cabinet 10.

In breaking down cabinet 10 to a collapsed, storage position, top portion 22 is removed and temporarily set aside. Doors 18 and 20 are opened so that shelves 130 and 122 may be removed from cabinet 10 and also set aside temporarily. When shelves 130 and 122 are removed, doors 18 and 20 are thus free to pivot inwardly with respect to legs 24 and 48, respectively. Further, rear portion 16 is free to be folded as previously described.

Figure 9:
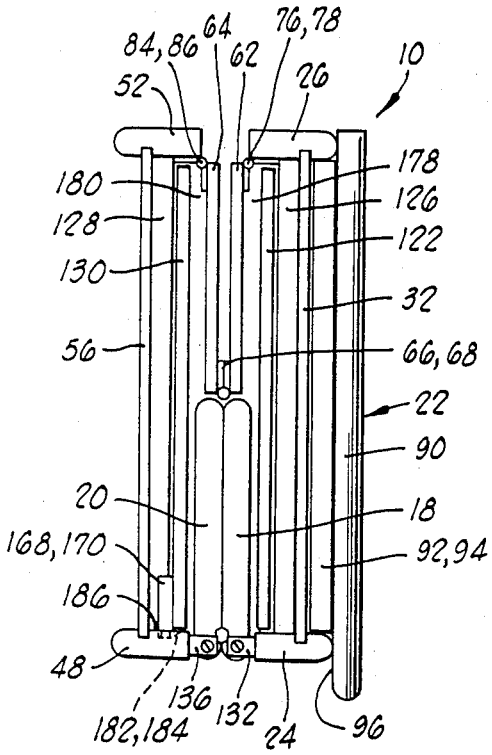
FIG. 9 is a top view of the apparatus in a collapsed, storage position.

Referring now to FIG. 9, cabinet 10 is shown in the collapsed, storage position. It will be seen that rear panels 62 and 64 are pivoted so that they are substantially parallel to one another and are substantially parallel to side panels 32 and 56. Thus, rear legs 26 and 52 are brought closer together. Also, doors 18 and 20 are pivoted inwardly approximately 90° such that they are parallel to one another and also parallel to side panels 32 and 56, bringing front legs 24 and 48 closer together. Thus, doors 18 and 20 can pivot through a total angle greater than 180°. The elimination of door pulls or other exterior hardware allows doors 18 and 20 to abut one another for providing a more compact collapsed position. It will be seen that doors 18 and 20 are totally enclosed in cabinet 10 when in the collapsed position. This is important because doors 18 and 20 are the most visible portions of the cabinet when assembled, and such a storage position reduces the likelihood of damage thereto.

A study of FIG. 9 will show that door 18, rear panel 62 and side panel 32 define storage means characterized by a cavity 178 therebetween. Similarly, a cavity 180 is defined between door 20, rear panel 64 and side panel 56 when in the storage position. Cavity 178 acts as a shelf storage cavity such that lower shelf 122 which has been previously removed may be stored in a vertical position therein. It will be noted that shelf 122 is thus adjacent intermediate support rib 126. Because lower support rib 118 is wider than intermediate support rib 126, shelf 122 will rest on lower support rib 118 which defines a lower boundary for cavity 178. Similarly, cavity 180 acts as a storage cavity for intermediate shelf 130, and intermediate shelf 130 is adjacent intermediate support rib 128 and rests upon lower support rib 120 which thus forms a lower boundary for cavity 180. For cabinets with additional shelves, storage cavities 178 and 180 are sized to accommodate a plurality of shelves as necessary.

In an alternate embodiment, an upper rib (not shown) may be positioned at the uppermost end of side portions 12 adjacent top portion 22 for additional support, which is particularly useful for tall cabinets. It will be seen that such an upper rib would define an upper boundary for storage cavities 178 and 180, thus containing any shelves stored therein. This is an advantage during shipping of collapsed cabinet 10.

Top portion 22 may be easily stored against side portion 12 between legs 24 and 26 as shown in FIG. 9. Obviously, top portion 22 could be identically placed against side portion 14 as well. Mounting ribs 92 and 94 fit between front leg 24 and rear leg 26 such that lower surface 96 of top panel 90 is adjacent the legs. Thus, while top portion 22 is separable from the rest of cabinet 10 in this storage position, it will be seen that it is adapted for optimum compactness, taking up as little space as possible.

Figure 10:
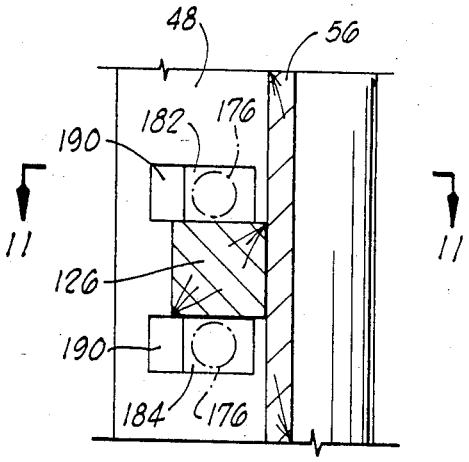
FIG. 10 is a cross section taken along lines 10—10 in FIG. 4 showing a detail of a latch receiving recess.
Figure 11:
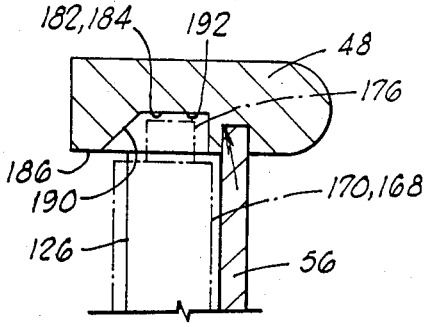
FIG. 11 is a cross section taken along lines 11—11 in FIG. 10.

Referring now to FIGS. 9–11, front leg 48 defines a pair of recesses 182 and 184 in an inner surface 186 thereof. As previously indicated, and as shown in FIG. 4, latches 168 and 170 have a plunger 176 which extends beyond the forward edge 188 of intermediate shelf 130. It will be clear that accommodation for the extension of plungers 176 must be taken into account when shelf 130 is stored in collapsed cabinet 10. Recesses 182 and 184 provide latch receiving means for plungers 176 on latches 178 and 168, respectively. Each of recesses 182 and 184 has a chamfered surface 190 which extends from inner surface 186 of leg 48 to a substantially straight lower surface 192. This chamfered surface 190 facilitates installation of shelf 130 in the storage position such that latches 170 and 168 straddle rib 126.

In the easiest break-down procedure, intermediate shelf 130 is placed in its storage position adjacent rib 128 such that plungers 176 of latches 170 and 168 extend into recesses 182 and 184 in leg 48 after shelves 130 and 132 are removed. Doors 18 and 20 are then hinged inwardly and side panels 32 and 56 are moved toward one another by folding rear portion 16 as previously described. Storage cavity 180 is thus formed for enclosing shelf 130. At this point, lower shelf 122 is easily lowered into its now formed storage cavity 178. Top portion 22 may then be put in its storage position.

Assembly into the set-up, operating position is simply a reverse of the break-down procedure, of course. No tools or special hardware of any kind are needed to set up or break down cabinet 10.

It can be seen, therefore, that the collapsible storage cabinet of the present invention is well adapted to carry out the objects and attain the ends and advantages mentioned, as well as those inherent therein. While a presently preferred embodiment of the invention has been described for the purposes of this disclosure, numerous changes in the construction and arrangement changes are encompassed within the scope and spirit of this invention as defined by the appended claims.

What is claimed is:

1. A collapsible cabinet comprising:

side support means;

back means hingingly attached to said side support means;

door means hingingly attached to said side support means and spaced from said back means, said door means defining a substantially vertical groove therein adjacent said side support means;

reversible hinge means for allowing:

inward pivotation of said door means to a position substantially parallel to said side support means; and outward pivotation of said door means, said groove in said door means being adapted for receiving an edge of said side support means as said door means is outwardly pivoted to a fully open position; and removable shelf means having a substantially horizontal operating position;

wherein:

said side support means, back means and door means define an enclosure when said cabinet is in a set-up, operating position in which said door means is substantially parallel to said back means when said door means is in a closed position, said door means being outwardly pivotable to said open position for providing access to said enclosure; and said back means and door means are movable to positions substantially aligned with one another and substantially parallel to said side support means when said cavity is in a collapsed, storage position, and said side support means, back means and door means define a storage cavity for receiving said shelf means when said cabinet is in said collapsed, storage position.

2. The cabinet of claim 1 further comprising latch means on said shelf means for releasably latching said door means when said shelf is in said operating position.

3. The cabinet of claim 2 further comprising latch receiving means in said storage cavity for receiving said latch means when said shelf is received in said storage cavity.

4. The cabinet of claim 1 further comprising reversible hinge means for allowing:

inward pivotation of said door means to a position substantially parallel to said side support means; and outward pivotation of said door means.

5. The cabinet of claim 4 wherein said reversible hinge means allows pivotation of said door means through an angle of at least 180°.

6. The cabinet of claim 4 wherein said reversible hinge means is characterized by a first hinge having a horizontal portion attached to a top edge of said door means and a second hinge having a horizontal portion attached to a bottom edge of said door means.

7. The cabinet of claim 1 wherein:

said side support means comprises a pair of spaced side portions; and said door means comprises a pair of doors, each of said doors being hingingly attached to a corresponding side portion.

8. A collapsible cabinet having a set-up, operating position and a collapsed, storage position, said cabinet comprising:

a pair of parallel, spaced side portions, each side portion having a front end and a rear end;

a rear portion extending between said side portions and hingingly attached thereto, said rear portion including a pair of rear panels hingingly foldable at a point between said side portions, said rear panels of said rear portion further being substantially perpendicular to said side portions when said cabinet is in said operating position, and said rear panels being movable to a position substantially parallel to said side portions when said cabinet is in said storage position;

a pair of doors, each door pivotally attached to a front end of one of said side portions and being pivotable inwardly and outwardly with respect to said side portions, each of said doors defining a longitudinal groove therein, said doors having:

an inwardly pivoted storage position substantially parallel to said side portions;

a closed operating position substantially perpendicular to said side portions, and aligned with the front ends of said side portions, such that said doors, said rear portion and said side portions define an enclosure therein corresponding to said operating position of said cabinet; and an outwardly pivoted, variably open position such that access is provided to said enclosure and wherein said groove in each of said doors receives therein an edge of an adjacent side portion when outwardly pivoted to a maximum open position; and at least one shelf having a horizontal operating position extending between said side portions and between said rear portion and said doors, said shelf preventing inward pivotation of said doors when in said horizontal operating position and being removable for storage.

9. The cabinet of claim 8 further comprising latch means on said shelf for latchingly retaining said doors in said closed operating position and adapted for releasing said doors for pivotation to said open operating position.

10. The cabinet of claim 9 wherein said latch means is characterized by a pair of touch-release latches, each of said latches positioned for latching one of said doors.

11. The cabinet of claim 8 wherein each of said side portions comprises:

a front leg having a longitudinal groove therein;

a rear leg having a longitudinal groove therein aligned with said groove in said front leg; and a substantially vertical side panel extending between said legs and having a front edge adapted for installation in said groove in said front leg and a rear edge adapted for installation in said groove in said rear leg.

12. The cabinet of claim 8 further comprising a top portion having a substantially horizontal operating position engageable with said side portions.

13. The cabinet of claim 8 further comprising a rib extending across said side portion, said rib defining a lowermost portion of said shelf storage cavity.

14. The cabinet of claim 13 further comprising a second rib spaced above said first-mentioned rib, said second rib being transversely narrower than said first-mentioned rib.

15. The cabinet of claim 8 further comprising:

a latch on said shelf; and wherein said side portion defining said shelf storage cavity further defines a latch receiving recess therein adapted for receiving a portion of said latch when said shelf is in said storage position.

16. A collapsible cabinet having an operating position and a collapsed, storage postion, said cabinet comprising:

side support means;

folding back means hingingly attached to said side support means, said folding back means being movable between an unfolded position substantially perpendicular to said side support means when said cabinet is in said operating position and a folded postion substantially parallel to and adjacent said side support means when said cabinet is in said storage position;

door means defining a longitudinal groove therein adjacent an edge thereof;

reversible hinge means for hingingly attaching said door means to said side support means on a side of said side support means opposite said back means, said edge of said door means being adjacent said side support means, whereby:

said door means may be pivoted between a closed operating position substantially perpendicular to said side support means and substantially parallel to said folding back means when said cabinet is in said operating position such that said cabinet defines an enclosure when in said operating position and an open operating position outwardly hinged from said side support means wherein an edge of said side support means is received in said groove; and said door means may be further pivoted inwardly to a position substantially parallel to and adjacent said side support means and adjacent said folding back means when said cabinet is in said storage position.

17. The cabinet of claim 16 wherein said reversible hinge means provides pivotation of said door means through an angle greater than 180°.

18. The cabinet of claim 16 further comprising removable shelf means positionable substantially horizontally in said enclosure when said cabinet is in said operating position.

19. The cabinet of claim 18 wherein said shelf means comprises means for preventing folding of said back means and inward pivotation of said door means when said cabinet is in said operating position.

20. The cabinet of claim 18 wherein said side support means forms a side of a storage cavity for storingly receiving said shelf means and wherein said folding back means and said door means define an opposite side of said storage cavity.

21. The cabinet of claim 16 wherein said reversible hinge means is characterized by an upper hinge having a portion attached to a top edge of said door means and a lower hinge having a postion attached to a bottom edge of said door means.

* * * * *

UNITED STATES PATENT AND TRADEMARK OFFICE

CERTIFICATE OF CORRECTION

PATENT NO. : 4,703,981

DATED : November 3, 1987

INVENTOR(S) : Stephen P. Stewart

It is certified that error appears in the above-identified patent and that said Letters Patent are hereby corrected as shown below:

Cover page, delete filing date of "January 22, 1987" and insert --January 22, 1986--.

Column 1, line 14, delete "Addition" and insert --Additon-- therefor.

Column 4, line 4, delete "B2" and insert --82-- therefor; line 40, delete "shelt" and insert --shelf-- therefor; line 53, insert --are-- after "128" and before "horizontally".

Column 7, line 61, after "arrangement", insert --of the parts can be made by those skilled in the art. All such--.

Claim 16, line 2, delete "postion" and insert --position-- therefor; line 16, delete "postion" and insert --position-- therefor.

Claim 21, line 4, delete "postion" and insert --portion-- therefor.

Signed and Sealed this

Seventeenth Day of May, 1988

*Attest:*

*Attesting Officer*

DONALD J. QUIGG

*Commissioner of Patents and Trademarks*